United States Patent [19]

Peters et al.

[11] Patent Number: 4,767,075

[45] Date of Patent: Aug. 30, 1988

[54] APPARATUS FOR FORMING A PLURALITY OF SUPPLY ROLLS CONSISTING OF RESPECTIVE WOUND STRIPS FORMED FROM A WIDE WEB BY SLITTING

[75] Inventors: Rudolf Peters, Lengerich; Rolf Kammann, Hagen, both of Fed. Rep. of Germany

[73] Assignee: Windmöller & Hölscher, Lengerich, Fed. Rep. of Germany

[21] Appl. No.: 43,131

[22] Filed: Apr. 27, 1987

[30] Foreign Application Priority Data

Apr. 28, 1986 [DE] Fed. Rep. of Germany ..... 3614344
Oct. 28, 1986 [DE] Fed. Rep. of Germany ..... 3636685

[51] Int. Cl.[4] ..... B65H 19/26; B65H 19/28
[52] U.S. Cl. ..... 242/56 A; 242/56.4
[58] Field of Search ..... 242/56 A, 56.2, 56.4, 242/56.5, 56.6, 56.9, 64

[56] References Cited

U.S. PATENT DOCUMENTS 3,157,371 11/1964 Billingsley ..... 242/56.2
3,378,213 4/1968 Habozit ..... 242/56.2 X
3,430,880 3/1969 Breacker et al. ..... 242/56 A
3,433,429 3/1969 Scnitzspahn ..... 242/56.4 X
3,472,462 10/1969 Young ..... 242/56 A

*Primary Examiner*—John M. Jillions
*Attorney, Agent, or Firm*—Fleit, Jacobson, Cohn & Price

[57] ABSTRACT

In apparatus for winding web material successively onto separate winding cores, the material is fed from a supply via a central guide roller to alternate winding assemblies carried by rotary frames. The apparatus has left- and right-hand rotary frames on opposite sides of the guide roller respectively and there are two winding assemblies on each frame. The winding assemblies can be moved along the frames in horizontal tracks, and the frames can be rotated so as to alternate the positions of the respective winding assemblies relative to the guide roller. The apparatus includes associated web cutters and slitters both for transverse cutting and lengthwise slitting of the web material so that full-width web rolls can be wound, or separate rolls can be wound from adjacent strips which have been slit longitudinally from the web.

16 Claims, 7 Drawing Sheets

APPARATUS FOR FORMING A PLURALITY OF SUPPLY ROLLS CONSISTING OF RESPECTIVE WOUND STRIPS FORMED FROM A WIDE WEB BY SLITTING

FIELD OF THE INVENTION

This invention relates to apparatus for forming a plurality of supply rolls consisting of respective wound strips. The strips may, for example, be formed from a wide web by slitting. The apparatus comprises guide rollers for guiding the web and strips, cutters for slitting the web, and winding means having winding cores for winding the strips.

DESCRIPTION OF THE PRIOR ART

Apparatus of the above type is known, e.g., from German Patent Publication No. 14 74 243 and from German Utility Model Specification No. 82 33 364.

SUMMARY OF THE INVENTION

It is an object of the invention to provide an apparatus of the kind described which is capable of forming high-quality supply rolls consisting of the wound strips and which permits a change of rolls to be effected in a simple manner substantially without interruption of the continuous feeding of the web.

Generally, in accordance with the invention, there is provided a winding apparatus which comprises pairs of winding assemblies located in respective tracks on opposite sides of a central guide roller. The winding assemblies and their tracks are carried on respective rotary frames so that the winding assemblies can be moved along the tracks and also each pair of winding assemblies can be rotated in the respective frame to position one or other of the assemblies adjacent the central guide roller. Thus, web material fed continuously to the central guide roller can be slit, if required, and directed alternately to the respective winding assemblies of each pair.

In an apparatus of the kind described, the object of the invention is thereby accomplished in that pairs of winding means are provided on each of the two sides of the central guide roller, which guides the web or slit strips along divergent paths. The winding means of each pair have parallel axes of rotation and are mounted in the respective rotary frame, which is rotatably mounted in the main frame of the machine. The rotary frame may comprise two reversing discs which are adapted to rotate in the frame and which are provided with rotary drives. The winding means of each pair are slidably mounted, for example, on suitable carriages, in the tracks of the reversing discs for movement parallel to themselves along a diameter of the reversing discs and they are adapted to be displaced along the tracks by suitable drives. Each winding means of each pair is movable from an end portion of the tracks to a position in which the winding means is adjacent to the center of the rotary frame. A winding means which has been moved to the inner end of the approximately horizontal track is adapted to cooperate with a cross cutter, which is pivoted in the main frame of the machine, and with an associated pressure-applying roller, and each of said cross cutter and the associated pressure-applying roller are operable to sever the web and to urge the succeeding web section at its leading end onto a glue-coated tube or the like, which constitutes a core for a supply roll to be wound.

By means of the apparatus in accordance with the invention, strips formed by slitting the web can be continuously wound and the operation need not be interrupted for a change of supply rolls. When a strip has been wound to form a supply roll of desired diameter on one of the winding means, pressure-applying rollers are pivotally moved into engagement with said supply roll. The carriage of the wound supply roll is then moved from adjacent the central guide roller to the center of the reversing discs so that the completely wound supply roll is coaxial to the rotary frame, which is then rotated through 180°. As a result, a fresh prepared roll core, e.g., a glue-coated core tube on the carriage of the other winding means of the pair, is pivotally moved to a position adjacent the central guide roller so that a new supply roll can be wound on said core. Then, when the rotary frame has been rotated to pivotally move the completely wound supply roll about its axis and to pivotally move the prepared roll core in an inward direction, the pressure-applying roller is applied to the fresh roll core. Thereafter, the cross cutter is actuated so that the strip which is running onto the complete supply roll is severed and at the same time the succeeding strip end defined by the cut is urged against the fresh roll core. The next supply roll is then wound on the new roll core. The completely wound supply roll is moved out of the center to the end portion of the tracks and is then removed. Thereafter, a new roll core is fitted on the pin or shaft of the winding means which previously carried the fully wound roll.

It is desirable that pivotal movements imparted to the rotary frame in preparation for a change of rolls should not result in fluctuations of the tensile stress of the web owing to changes in the length of the web. For this purpose, it is contemplated within the scope of the invention to move an almost completely wound supply roll to a position in which the roll is coaxial to the rotary frame and then to lock the supply roll to the rotary frame in a position in which the winding axis of the associated winding means is axially aligned with the axis of rotation of the rotary frame.

To ensure that the supply rolls will be effectively and tightly wound, it is also contemplated within the scope of the invention that the central guide roller comprises a contact roller, which is in contact with the supply rolls being wound. The use of a contact roller will oppose an entrapping of air and will permit a tangential feeding of the strip to be wound under the desired tensile stress.

The apparatus may further include rollers pivoted by levers to the main frame of the machine and which are adjustable to engage the supply rolls at locations between supply rolls that have been moved to the center of the respective rotary frame and the contact roller. Before a supply roll is moved to the center of the rotatable frame, i.e., at the beginning of a change of supply rolls, said rollers are pivotally moved against the supply roll and remain there until the change of supply rolls has been effected and the completed supply roll is removed from the machine. Said rollers are provided to prevent lateral wandering of the web during a changeover of rolls and to oppose an entrapping of air when supply rolls are removed from the contact roller.

The pair of winding means which are movably mounted in each rotatable frame may be moved along the associated tracks by drive screws or by fluid-operable piston-cylinder units. In order to save space, it is suitable to use so-called rodless pneumatic cylinders, which are formed with longitudinal slots, in which pins are guided, which are directly connected to the pistons and to those parts of the winding means which are to be moved by said cylinders.

Because pneumatic cylinders do not ensure a perfect synchronization, it is also contemplated within the scope of the invention that mutually opposite carriages are provided, which are movable along the tracks and carry the winding means and the associated drives. Synchronization may be effected by chains, which extend around the rims of the reversing discs in tracks that are concentric to the axis of rotation. The chains are connected at their ends to the carriages and are trained around chain sprockets, which are non-rotatably connected to shafts. The shafts are rotatably mounted in the main frame at fixed positions. The winding means on both sides are coupled to each other by means of the chains, chain sprockets and the shaft so that both carriages will be parallel to the contact roller and canting will be avoided.

It will be understood that the web can be slit to form more than two strips and that said strips can be guided alternately over the contact roller to the left and right, respectively, and can be wound in the described manner on coaxial winding cores of the winding means, which winding cores preferably consist of frictional winding shafts.

In use of winding apparatus, it is sometimes desired to wind the unslit web so as to form a wide supply roll without the use of special winding means. In that connection, it is particularly desirable to avoid an interruption of the feeding of the web for a change in operation from the winding of two or more strips formed by slitting to the winding of the unslit web. To permit such an expansion of the field of application of the apparatus, it is contemplated by the invention that the cutters for slitting the web are adapted to be lifted from the web and a cross cutter which is pivoted by means of levers to the machine frame on one side of the guide roller is adapted to be actuated to sever one of the strips which run to respective supply rolls or those of said strips which run toward one side. Thereafter, the unsevered strip or strips is or are used to pull the succeeding unslit web to the winding means on the other side. Thereafter, the strip or strips which moves or move ahead is or are severed as described, a new long core tube is provided, and the remaining lengths of the unsevered strips are wound as leaders on said long tube and pull the unslit web behind them. That web is subsequently wound only on one side of the apparatus. During the winding of a wide web, an exchange of supply rolls will also be effected in the manner described hereinbefore.

The field of application of the apparatus can be extended further in such a manner that a change is permitted from the winding of a wide web, e.g., of plastic film, which is wound only on one side of the apparatus, to the winding of two or more strips, which have been formed by slitting and are wound on both sides of the central guide roller. For this purpose, it is contemplated within the scope of the invention that a web lifter is pivoted in the machine frame by means of levers. The web lifter is coaxial to the guide roller, extends throughout the length of the guide roller and is provided with a cutter for severing only said one strip or one set of strips. For a change in operation from the winding of a web to the winding of two or more strips formed by slitting, the cutters for slitting the web are pivotally moved to their operative positions. At the same time or thereafter, the web lifter is pivotally moved from an inoperative position, in the direction of travel of the web so that the web lifter then lifts the web from the central guide roller, or contact roller. Thereafter, a prepared new roll core, e.g., a glue-coated core tube, is moved by the associated winding means into engagement with the strip that is to be wound by the other winding means, and said roll core is urged against the contact roller. The strip can now be wound on said roll core when the strip has previously been severed by the cutter of the web lifter so that the strip to be wound has been provided with a leading end. The strip which has been formed by slitting then continues to move ahead over the web lifter to those winding means in which the completely wound supply roll consisting of the web is rotatably mounted. As soon as the strip has moved into contact with the completely wound long supply roll, a change of supply rolls is effected in the manner described, and the new roll core is constituted by a properly prepared short roll core or core tube.

The cutter of the web lifter suitably severs the strip which moves to the winding means and contacts the guide roller only with a smaller angle of wrap.

Also, within the scope of the invention, it is contemplated that the web lifter have a curved low-friction surface formed with perforations for discharge of compressed air. In this embodiment, the web lifter is formed with a chamber, which is supplied with compressed air through suitable ducts and rotary seals.

The cutter associated with the web lifter may be transversely slidably guided in a longitudinal slot of the web lifter and may be operable by a piston of a rodless cylinder.

The web lifter and/or the pivoted cutters may be suitably pivoted by bearing rings to the shaft of the guide roller.

It is apparent that the invention can be embodied in an apparatus which comprises slitting means and two winding stations, which are provided with reversible winders.

It is also possible to wind the unslit web in one winding station. In that case, winding can be effected by a coreless winder or by a winding shaft.

The apparatus can be properly controlled to effect a fully automatic change from the winding of a wide web to the winding of slit strips and vice versa.

In an apparatus embodying the invention, a change of the mode of operation will involve a loss only of short web or strip lengths as waste. The supply rolls being formed will engage the central guiding or contact roller so that an entrapping of air and creasing will be prevented.

Throughout the change of supply rolls, the length of the web or strips and the tensile stress thereof will change only slightly so that the supply roll portions wound during a change of rolls will also be of high quality. This is due to the following measures:

The supply rolls are moved to the center of the reversing discs before the reversing discs are pivotally moved.

A pressure-applying roller is engaged with the supply roll or rolls before the supply roll or rolls is or are moved and before the pivotal movement of the reversing discs is performed.

The location at which the pressure-applying roller contacts the supply roll or rolls is almost the same as the location at which the incoming strip or web first contacts the supply roll or rolls. This will ensure that the movement of the supply roll to the center of the reversing disc will effect only a slight change of the length of the incoming strip or web so that substantial changes in tensile stress, which might cause the strip or web to wander, will not occur.

The means for effecting a change of supply rolls are so designed that the pressure-applying rollers of the roll-changing means will be contacted by the incoming strip or web only around a small angle so that the length and tensile stress of the incoming strip or web will remain substantially unchanged.

DETAILED DESCRIPTION OF THE PREFERRED EMBODIMENT

Figure 1:
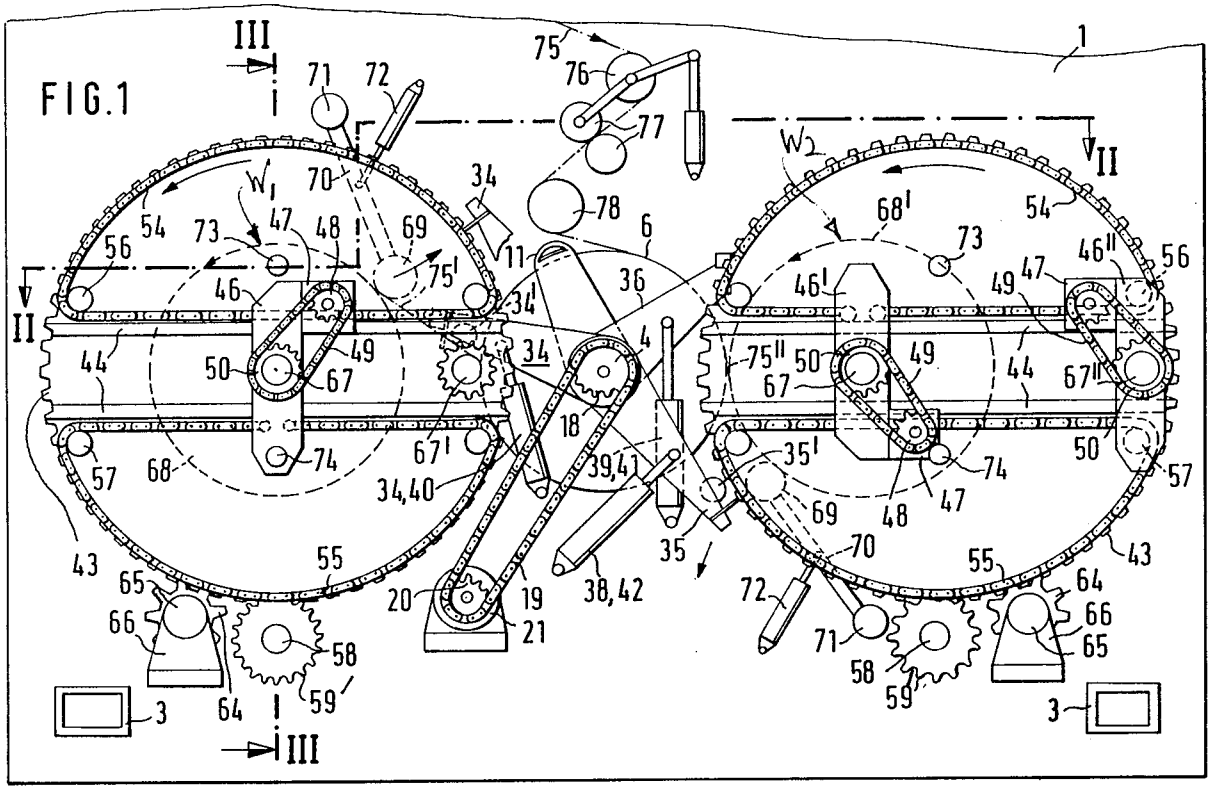
FIG. 1 is a diagrammatic side elevational view of a winding apparatus in accordance with the invention.

An illustrative embodiment of the invention will now be explained in detail with reference to the drawing.

Figure 2:
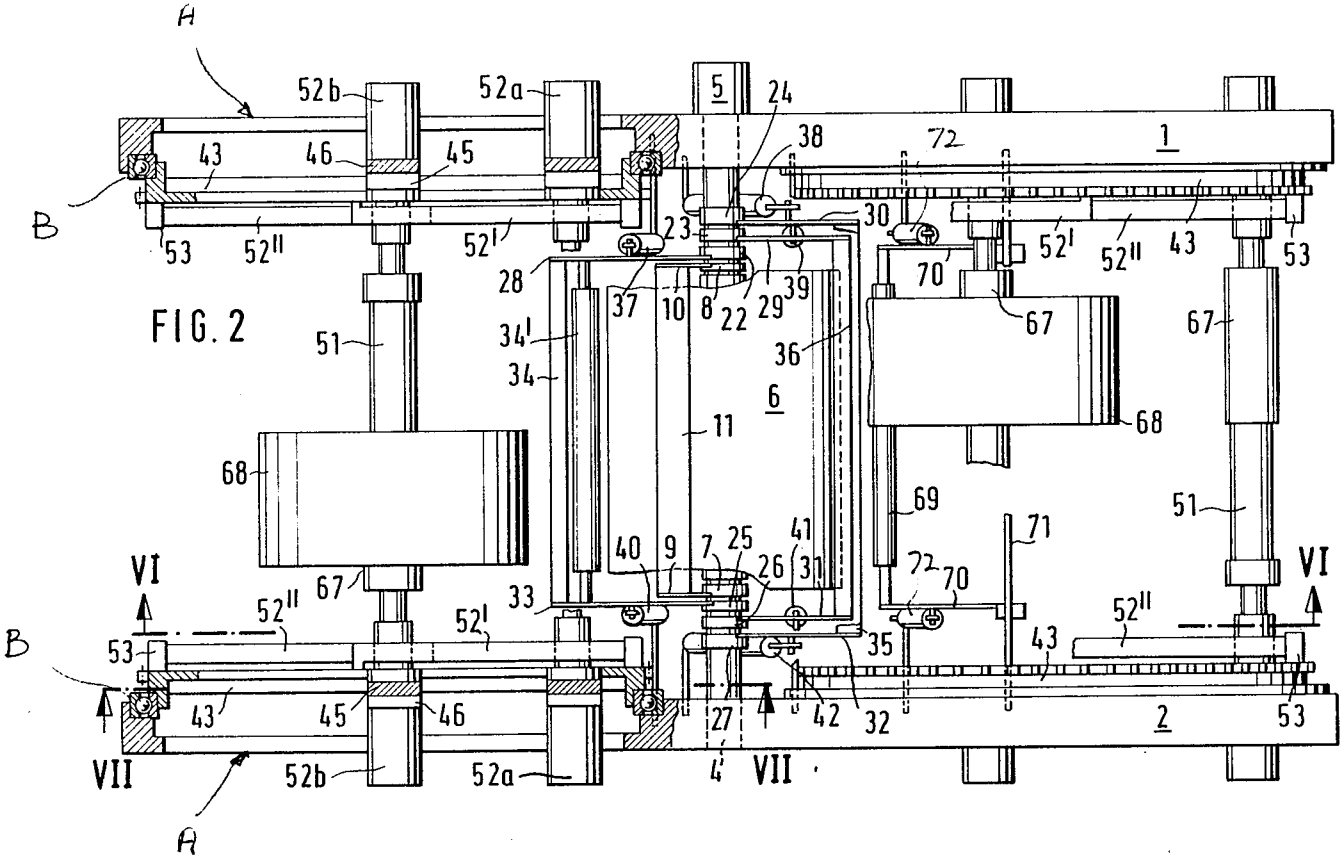
FIG. 2 is a plan view on line II—II in FIG. 1.

The two side walls 1, 2 of a frame are interconnected by cross beams 3 and by a centrally disposed shaft 4 (FIGS. 1 and 2). The shaft 4 is rotatably mounted in the side walls 1 and 2 and is adapted to be driven by a motor 5. A contact roller 6 is carried by and non-rotatably connected to the central portion of the shaft 4. Two bearing rings 7 and 8 are freely rotatably mounted on the shaft 4 near the contact roller 6. Each bearing ring 7 or 8 is rigid with a lever arm 9 or 10. At those ends which are remote from the bearing rings 7 and 8, the lever arms 9 and 10 carry a web lifter 11, which is more clearly shown in FIG. 5, and which extends throughout the length of the contact roller 6. As is also apparent from FIG. 5, the web lifter 11 consists of a tube 12, which is approximately semicircular in cross section and which contains a rodless cylinder 13. Cylinder 13 contains a piston 13*a*, which is firmly connected to a cutter carrier 14, which protrudes through a slot 15 of the tube 12. A cutter blade 16 is secured to the free end of the cutter carrier 14. The tube 12 is formed with a plurality of slots 17, through which compressed air can be blown to the outside. The web lifter is pivotally movable, e.g., from a position shown in FIG. 1 to a position shown in FIG. 5. For this purpose, a chain sprocket 18 is connected to the bearing ring 7 (FIG. 4) and is operatively connected by a chain 19 to a chain sprocket 20, which is non-rotatably connected to the output shaft of a gearmotor 21.

Additional bearing rings 22 to 27 (FIG. 2) are rotatably mounted on the shaft 4 beside the bearing rings 7 and 8 and are coaxial to the latter. The bearing rings 22 to 27 are rigid with respective pivotally movable lever arms 28 to 33. Transverse cutter bars and cutters 34, 35 and 36 are secured each to the ends of two of the lever arms 28 to 33. Close to the cutter bars 34 and 35 are provided respective pressure-applying rollers 34' and 35', which are rotatably mounted between the lever arms 28, 33 and 30, 32. The cutter bars 34 to 36 are pivotally movable by piston-cylinder units 37 to 42, which are connected by brackets (not shown) to the side walls 1 and 2 of the machine frame.

Figure 3:
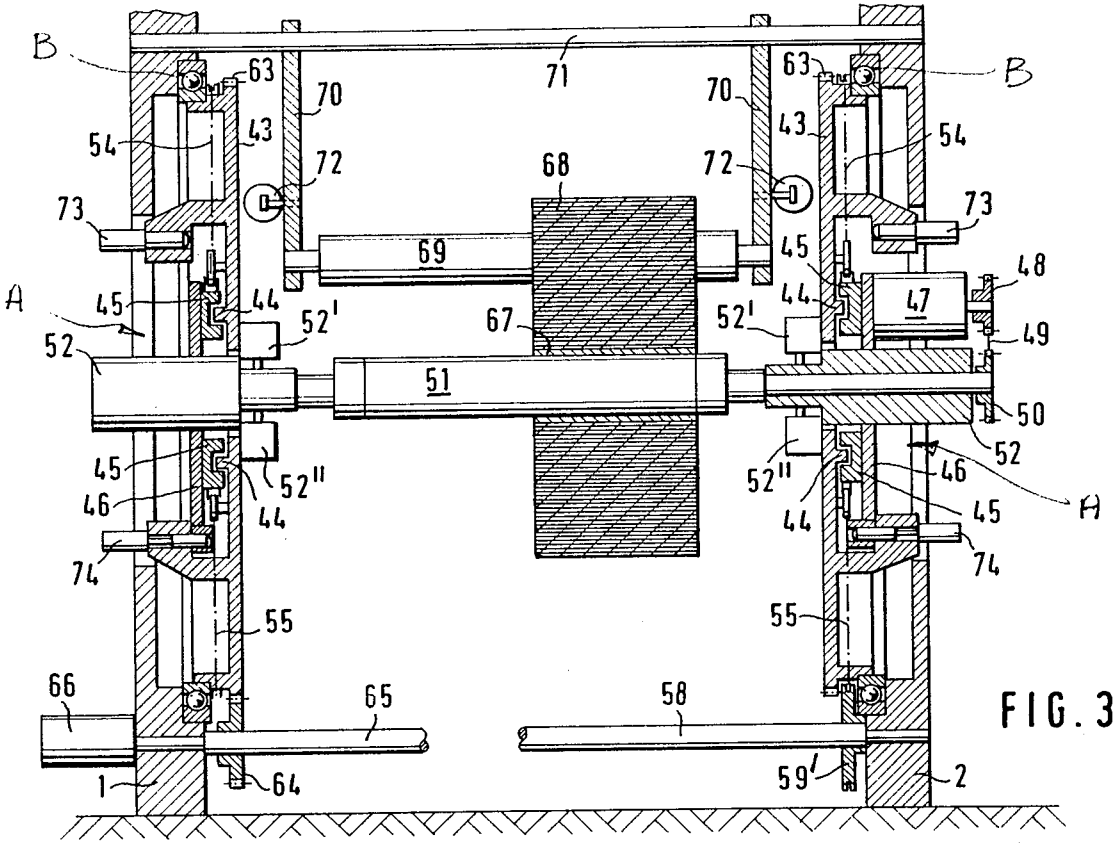
FIG. 3 is a sectional view on line III—III in FIG. 1.

As shown in FIGS. 2 and 3, each of the side walls 1 and 2 of the frame is formed with left and right circular apertures A on opposite sides of shaft 4. Only the left-hand apertures are shown in detail in the drawings but these are repeated on the right. A large ball bearing B is secured in each of said apertures. A reversing disc 43 is rotatably mounted in each of said ball bearings. Each of the four reversing discs 43 is provided with two parallel riblike linear tracks 44. The two linear tracks 44 of each reversing disc 43 are embraced with a clearance by respective channel members 45. The two channel members 45 associated with each reversing disc 43 are each secured to a separate mounting plate 46. A motor 47 is secured by screws to each mounting plate and has a shaft, to which a chain sprocket 48 is non-rotatably connected. Each chain sprocket 48 is operatively connected by a chain 49 to a chain sprocket 50, which is non-rotatably connected to a winding shaft 51. The latter is rotatably mounted in bearings 52*a*, 52*b*, which are mounted at fixed locations in mutually opposite mounting plates 46. Rodless piston-cylinder units 52', 52'' are operable to displace two mutually opposite mounting plates 46 along the linear tracks 44. It is apparent that there are thus two winding shafts 51 on each side of contact roller 6. The two winding shafts are carried between respective plates 46. The opposed pairs of plates can be moved independently along tracks 44 by respective piston-cylinder units 52', 52'' and the tracks themselves are formed on rotary reversing discs 43.

It is apparent from FIG. 2 that the two upper piston-cylinder units 52' shown in FIG. 3 serve to displace the winding shaft bearings 52*a* and the two lower piston-cylinder units 52'' serve to displace the two winding shaft bearings 52*b*. The piston-cylinder units 52', 52'' are only partly shown in the right-hand half of FIG. 2 but the relations on this side are the same as those on the left-hand side of FIG. 2. All piston-cylinder units 52', 52'' are secured to the associated reversing discs 43 by brackets 53. Because the piston-cylinder units 52', 52'' are pneumatically operated, care must be taken to synchronize the piston-cylinder units 52', 52'' as they displace a winding shaft 51 so that said shaft will not assume an oblique position. For this purpose, two parallel-motion chains 54 and 55 are respectively trained around the top and bottom halves of each reversing disc 43. The upper parallel-motion chain 54 is trained around deflecting rollers 56 (FIG. 7) and connected to the mounting plate 46'. The lower parallel-motion chain 55 is trained around deflecting rollers 57 and secured to the mounting plate 46'.

Figure 7:
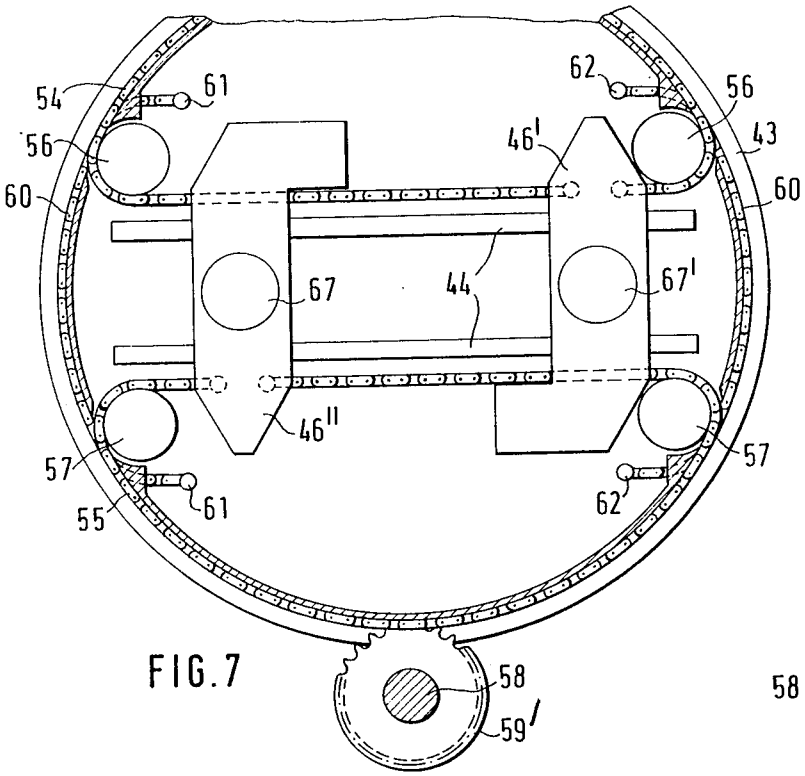
FIG. 7 is a sectional view on line VII—VII in FIG. 2.

As is apparent from FIGS. 3 and 7, a continuous shaft 58 is rotatably mounted below the reversing discs 43.

The two lower parallel-motion chains 55 are trained around respective chain sprockets 59', which are non-rotatably connected to the shaft 58. In the central region of each reversing disc, the upper chain 54 and the lower chain 55 are spaced apart. That distance between the chains 54 and 55 is bridged by two connecting chains 59 and 60 which, at their ends 61 and 62, are secured to the associated reversing disc. It is apparent from FIG. 3 that the connecting chains 59 and 60 extend on one side of the parallel-motion chains 54 and 55. The chain sprocket 59' consists of a wide double chain sprocket for meshing with the connecting chains 59 and 60 and with the parallel-motion chains 54 and 55.

Each reversing disc 43 is provided on its periphery with gear teeth 63, which mesh with a gear 64. Only one of the gears 64 is shown in FIG. 3. The two gears 64 associated with two reversing discs 43 are operatively connected by a shaft 65 for driving the reversing discs and can be driven by motor 66, which is fixedly mounted on one side wall of the frame and has an output shaft that is flange-connected to the shaft 65 for driving the reversing discs.

A plurality of core tubes 67 are shown fitted on the respective winding shafts 51. Each of said core tubes has a length corresponding to the width of the strip to be wound. Supply rolls 68 of strip material are shown wound on respective core tubes 67. A pressure-applying roller 69 is associated with each of said supply rolls. Said pressre-applying rollers 69 are pivoted by respective levers 70 to a rod 71, which is mounted in the side walls of the frame. The pressure-applying rollers 69 are pivotally moved by means of pneumatic piston-cylinder units 72.

It is apparent from FIG. 3 that each reversing disc 43 is provided with two locking pins 73, 74, which are adapted to engage the mounting plates 46 in respective openings to lock the mounting plates 46 against movement relative to the reversing discs 43. The pins are positioned to lock plates 46 in a coaxial position with respect to the reversing disc as shown on the left-hand half of FIG. 1.

The mode of operation of the apparatus will now be described more in detail.

As is apparent from FIG. 1, a wide continuous web 75 is fed around a guide roller 76 to a slitter 77 for slitting the web into two or more strips. Said strips are fed around a deflecting roller 78 to the contact roller 6. The two strips are respectively wound onto cores 67 at the winding stations $W_1$ and $W_2$ shown on the left-hand and right-hand sides of FIG. 1. In FIG. 1, an almost complete supply roll 68 of wound strip is shown in the left-hand winding station $W_1$. By means of the upper piston-cylinder units 52' shown in FIGS. 2 and 3, the winding shaft 51 carrying said almost complete supply roll 68 has been displaced to the coaxial position in plate 43 by means of the upper piston-cylinder units 52' shown in FIGS. 2 and 3 and has been locked there by pin 74. One of the mounting plates 46 associated with the supply roll 68 that is in the coaxial position is apparent in FIG. 1. In addition to the two mounting plates 46 which carry the supply roll 68, the two left-hand reversing discs 43 carry two additional mounting plates 46 and shaft 51, which are not shown in FIG. 1 for the sake of simplicity. A glue-coated core tube 67' has been fitted on and fixed to the winding shaft which is carried by said additional mounting plates. The core tube 67' has been provided with glue strips. It is apparent that the strip 75' extends around the contact roller 6 and past the core tube 67' to the supply roll 68, against which the strip is urged by the pressure-applying roller 69. As soon as the supply roll 68 has been completed, the piston-cylinder units 37 and 40 are operated to impart to the cutter bar 34 and the associated pressure-applying roller 34' a pivotal movement into engagement with the strip 75'. As a result, the pressure-applying roller 34' first urges the strip 75' against the glue-coated core tube 67'. By means of a rodless cylinder, the cross cutter 34 is then operated to sever the strip 75'. By the pressure-applying roller 34' associated with the cutter bar 34 the leading end of the follow-up strip is now urged against the glue-coated core tube 67' on which the succeeding strip is subsequently wound to form a new supply roll. The now completed supply roll 68, after unlocking pin 74, is moved to the extreme outer end position on the left of racks 44, by piston-cylinder unit 52'', and is then removed from the winding shaft.

On the right in FIG. 1, a supply roll 68' is shown, which has not yet been completely wound and continues to receive the second strip 75'' slit from web 75. As soon as the roll 68' has been completely wound, the pressure-applying roller 69 is pivotally moved against the supply roll 68' and the mounting plates 46' carrying the roll are displaced to the right to the center of the two reversing discs 43 and are locked in that central position by right-hand pin 73. When the two mounting plates 46' have been locked, the drive motor 66 is operated to rotate the reversing discs 43 in a counterclockwise sense in FIG. 1 until a new core tube 67'' which has been fitted on winding shaft 51 between plates 46'' is in winding position adjacent roller 6 and the two linear tracks 44 are again horizontal. When this has been effected, the piston-cylinder units 38 and 42 are operated to pivotally move the cutter bar 35 in the counterclockwise sense in FIG. 1 so that the strip 75'' can be severed and the winding of a new supply roll can be initiated. It is apparent that in the arrangement shown in FIG. 1 it is possible to form consecutive supply rolls on the left-hand and right-hand sides of the apparatus without an interruption of the operation.

If it is subsequently desired not to slit the web 75 and to wind only a single, wide web rather than two or more strips, the wide web will be wound only in the winding station which is shown on the left in FIG. 1. For that purpose, the pressure-applying rollers 69 are pivotally moved into engagement with the supply rolls. Thereafter, the mounting plates 46' shown on the right in FIG. 1 are displaced until they are coaxial to the reversing discs 43 and are locked in that coaxial position. A drive motor 66 is then operated to rotate the reversing discs 43 through 180° until the mounting plates 46'' are in the position which is shown on the right. For that mode of operation, the winding shaft that is carried by the mounting plates 46'' has been removed to provide a clear passage for the cross cutter 36 so that the latter can sever the strip which continues to run onto the supply roll 68'. The strip portion 75' which extends from the cut made by the cutter 36 to the full-width web 75 is pulled around the contact roller 6 by the strip 75'.

Figure 6:
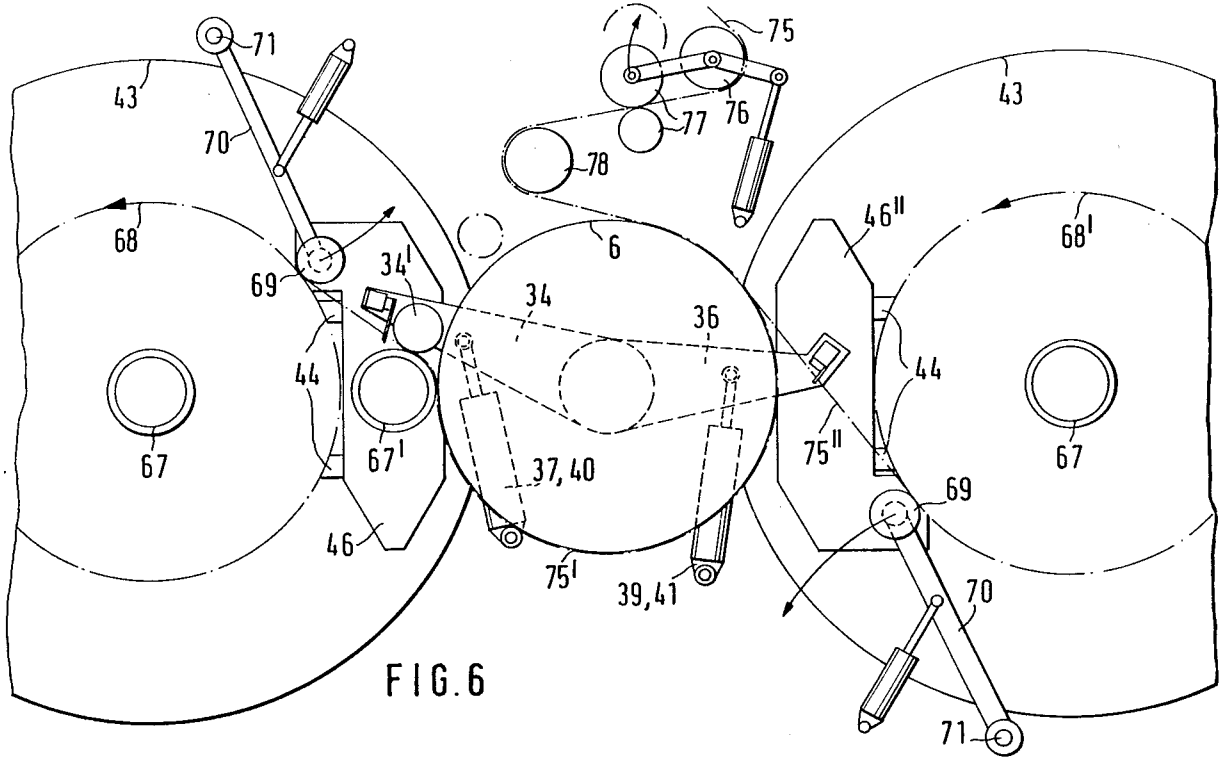
FIG. 6 is a sectional view on line VI—VI in FIG. 2 and illustrating the change from the winding of a plurality of strips to the winding of a wide web.
Figure 8:
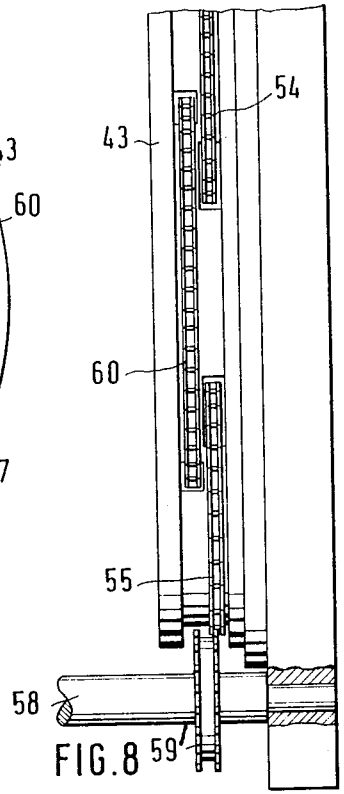
FIG. 8 is a side elevational view of a reversing disc shown in FIG. 7, with means for operating the reversing disc in synchronism.

As soon as the unslit web 75 has moved past the core tube 67', which has a length that is equal to the width of the unslit web 75, the cross cutter 34 is operated to sever the web 75. Thereafter, the unslit web 75 is wound on the core tube 67', which has previously been provided with glue. During the continued operation, that part of the apparatus which is shown on the right in FIG. 6 is not operated at all and the left-hand part of the apparatus is used for a continuous operation to form consecutive supply rolls having an axial length that is equal to the width of the web being supplied. The exchange of supply rolls on the left is effected in the manner which has previously been described with reference to FIG. 1.

Figure 4:
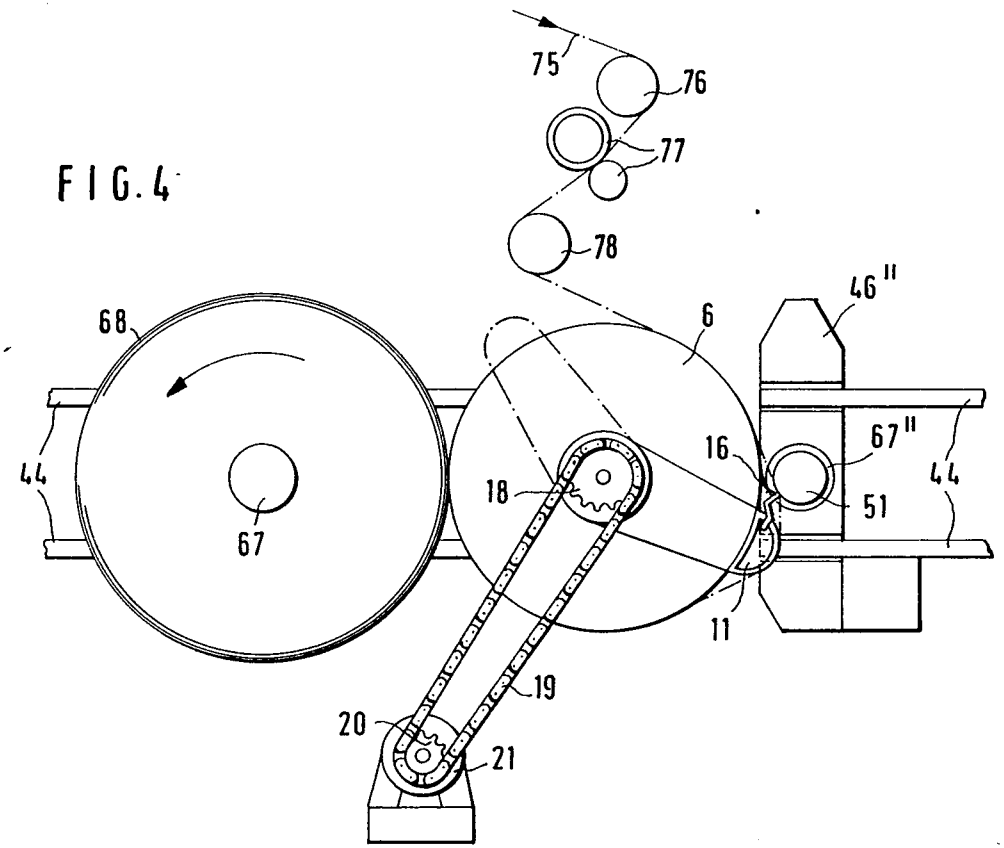
FIG. 4 is a diagrammatic elevational view of central portions of the winding apparatus shown in FIG. 1 during a change in the mode of operation from the winding of a wide web of plastic film in one winding station to the winding of strips which have been formed by slitting a web and which are wound in two winding stations.
Figure 5:
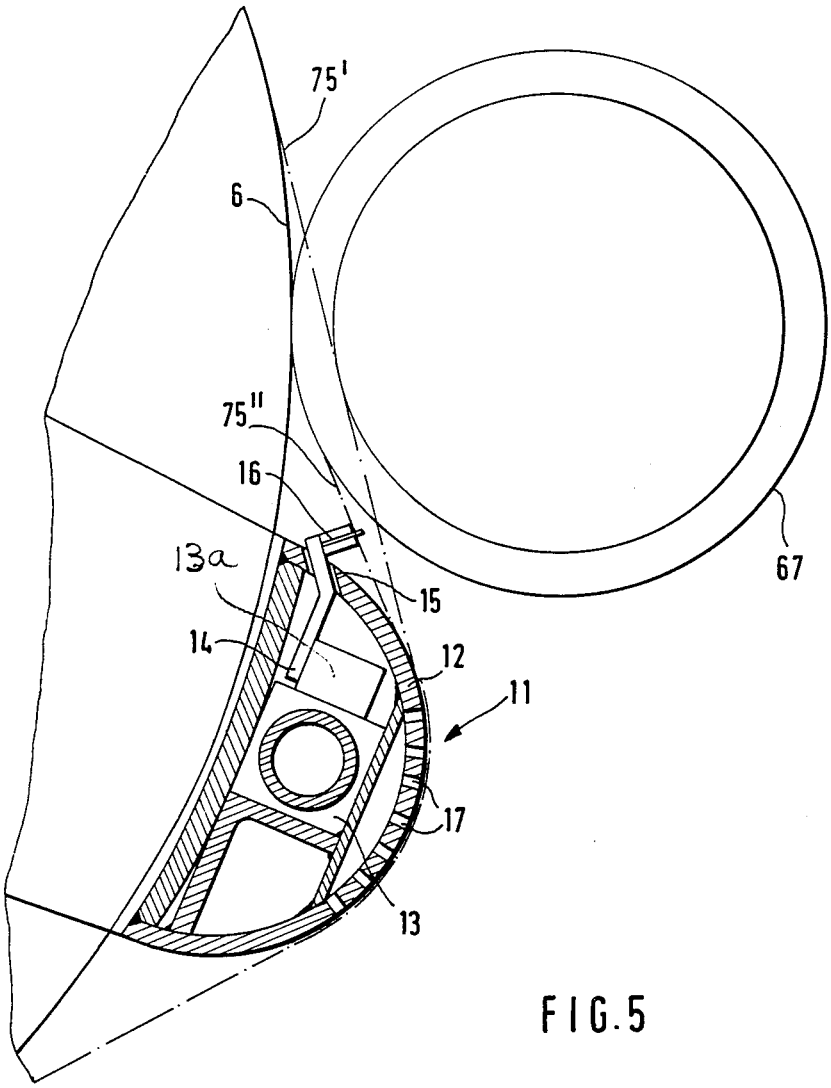
FIG. 5 is an enlarged sectional elevational view showing the web lifter of FIG. 4 after pivotal movement to its operative position.

From that mode of operation which is shown in FIG. 6 and in which a wide web is wound on the left-hand part of the apparatus, the apparatus in accordance with the invention can be changed without an interruption of its operation to a mode in which two strips are respectively wound on the left-hand and right-hand sides of the apparatus as previously described. For that purpose, the drive motor 21 is operated to impart to the web lifter 11 a pivotal movement from its position of rest, indicated in phantom in FIG. 4, to an operative position shown in solid lines. That position is also shown in FIG. 5. During the pivotal movement of the web lifter 11, mounting plates 46'' are remote from the contact roller 6 (FIG. 1). Only when the web lifter 11 has reached the position shown in FIGS. 4 and 5 is the slitter 77 moved to its operative position so that the web 75 is slit to form two strips 75', 75''. Thereafter, the mounting plate 46'' is moved along the linear tracks 44 to the position shown in FIG. 4. The winding shaft 51 has previously been inserted into the mounting plates 46'' and carries a core tube 67'' which has a length that is equal to the width of the strip that is to be wound thereon. The core tube 67'' urges the strip 75'' against the contact roller 6. The strip 75' is not engaged by the core tube 67'' because the core tube 67'' and the strip 75'' contact each other in perfect axial register.

The cutter 16 of the web lifter is then operated to sever only the strip 75'' whereas the strip 75' remains unsevered.

Because glue has been applied to core tube 67'' before it has been fitted, the strip 75'' is subsequently wound on the core tube 67'' while the strip 75' runs up on the supply roll 68, which consists of the previously wound wide web 75. When this has been effected, a change of rolls is effected on the left part of the apparatus. For that purpose, the supply roll 68 is moved to a position in which it is coaxial to the reversing discs 43 and is locked in that position.

The motor 66 is then operated to impart a rotation through 180° to the two reversing discs which are associated with the supply roll 68 so that a new core tube 67' is pivotally moved to the winding position. The resulting position is that which is shown on the left in FIG. 2 with the difference that the supply roll 68 shown in FIG. 2 has a small axial length.

What is claimed is:

1. Apparatus for winding web material successively onto separate winding cores comprising a main frame, a web guide roller mounted substantially centrally in the frame, left-and right-hand rotary frame means mounted in the main frame on opposite sides of the guide roller respectively, track means provided on each rotary frame means, first and second winding means mounted on each track means for independent movement therealong toward and away from the guide roller, each winding means including a winding shaft for receiving a winding core and a first drive means for rotating the winding shaft, second drive means for selectively moving the respective winding means along the respective track means, and third drive means for selectively rotating the rotary frame means to alternate the positions of the respective first and second winding means relative to the central guide roller.

2. Apparatus as defined in claim 1 including respective cross cutters pivotally mounted on the main frame on opposite sides respectively of the guide roller for severing web material which has been wound on a winding means remote the guide roller, the cross cutters being mounted on respective pivot arms which also carry associated pressure-applying rollers for pressing the web onto a web core on a winding means adjacent the guide roller, and means for moving the pivot arms between operative and inoperative positions.

3. Apparatus as defined in claim 1 including releasable latch means for clamping the respective winding means in a position along the respective track means wherein the axis of rotation of the respective winding shaft coincides with the axis of the respective rotary frame means.

4. Apparatus as defined in claim 1 wherein the guide roller defines a contact roller for contact with a roll of web material being wound on a respective one of the winding means.

5. Apparatus as defined in claim 1 wherein the guide roller defines a clearance with a roll of web material being wound on a respective one of the winding means.

6. Apparatus as defined in claim 1 which further includes guide roller means pivotally mounted on lever means on the main frame for engaging a roll of web material wound on a respective one of the winding means to prevent lateral wandering of the web during a changeover of winding means and prevent entrapment of air in a roll being wound.

7. The invention as defined in claim 1 wherein the second drive means includes fluid operable piston and cylinder means.

8. The invention as defined in claim 1 wherein each of the left- and right-hand rotary frame means includes a pair of spaced rotary discs, the track means includes aligned track elements on each disc, the respective winding means each includes a winding shaft supported between carriages mounted for movement along the respective track elements, and the apparatus includes synchronization means for synchronizing movements of the respective carriages along the respective track elements.

9. The invention as defined in claim 8 wherein the synchronization means comprises respective chains wound around the respective rotary discs, the chains being connected at their ends to the respective carriages and the chains being wound around respective chain sprockets carried on a common shaft extending between the respective chains.

10. The invention as defined in claim 1 wherein the apparatus includes feed means for the web material and cutter means for continuously slitting the web material lengthwise into adjacent strips to be wound respectively on the winding means of the left- and right-hand rotary frames.

11. The invention as defined in claim 10 including means for removing the cutter means from the web material and cross cutter means for severing the respective adjacent strips to convert the apparatus for use in winding unslit web material.

12. The invention as defined in claim 10 including a pivotal web lifter and associated cross cutter means on the frame for transferring end portion of web material for winding as between the left- and right-hand rotary frame means.

13. The invention as defined in claim 12 wherein the pivotal web lifter and cross cutter is adapted to cut one of the adjacent strips for transfer to the respective winding means and which contacts the guide roller with the smaller angle of wrap as between the strips.

14. The invention as defined in claim 12 wherein the web lifter means has a curved low-friction web lifter surface provided with air-discharge perforations.

15. The invention as defined in claim 12 wherein the web lifter extends transversely across the guide roller and defines a cylinder of a rodless piston-cylinder assembly, the assembly having a piston which carries the cross cutter.

16. The invention as defined in claim 12 wherein the web lifter and associated cross cutter are carried on pivot arms journalled on a shaft which supports the guide roller.

* * * * *